US008035605B2

(12) United States Patent
Tsujii

(10) Patent No.: US 8,035,605 B2
(45) Date of Patent: Oct. 11, 2011

(54) LIQUID CRYSTAL DISPLAY DEVICE

(75) Inventor: Takayuki Tsujii, Hsinchu (TW)

(73) Assignee: Au Optronics Corp., Hsinchu (TW)

( * ) Notice: Subject to any disclaimer, the term of this patent is extended or adjusted under 35 U.S.C. 154(b) by 977 days.

(21) Appl. No.: 11/845,824

(22) Filed: Aug. 28, 2007

(65) Prior Publication Data

US 2008/0088574 A1 Apr. 17, 2008

(30) Foreign Application Priority Data

Oct. 17, 2006 (JP) ..... 2006-282970

(51) Int. Cl.
*G09G 3/36* (2006.01)

(52) U.S. Cl. ..... 345/102; 345/101; 345/87

(58) Field of Classification Search ..... 345/101–102, 345/87, 89, 98, 99, 100; 305/101, 102
See application file for complete search history.

(56) References Cited

U.S. PATENT DOCUMENTS

| | | | | |
|---|---|---|---|---|
| 6,348,910 | B1 * | 2/2002 | Yamamoto et al. | 345/102 |
| 6,590,555 | B2 * | 7/2003 | Su et al. | 345/92 |
| 6,943,506 | B2 | 9/2005 | Moon | |
| 7,205,975 | B2 * | 4/2007 | Kim | 345/102 |
| 7,321,207 | B2 * | 1/2008 | Moon | 315/323 |
| 7,385,583 | B2 * | 6/2008 | Kim et al. | 345/102 |
| 2005/0083294 | A1 | 4/2005 | Kim et al. | |

FOREIGN PATENT DOCUMENTS

| | | |
|---|---|---|
| CN | 1501141 | 6/2004 |
| CN | 1516103 | 7/2004 |
| JP | 10-307284 | 11/1998 |
| JP | 11202286 | 7/1999 |

OTHER PUBLICATIONS

CN office action mailed May 16, 2008.
English language translation of abstract of JP10-307284.
Taiwanese language office action dated Jul. 25, 2011.
English language translation of abstract of CN 1516103 (published Jul. 28, 2004).

* cited by examiner

*Primary Examiner* — Duc Dinh
(74) *Attorney, Agent, or Firm* — Thomas|Kayden

(57) ABSTRACT

A liquid crystal display device is provided to reduce the edge-blurred influence of the liquid crystal response in accord with temperature dependency, comprising a temperature detector in an inverter circuit detecting the temperature of a liquid crystal display panel and outputting a temperature signal of the liquid crystal; a phase synchronous signal generator outputting the on/off timing signal of each fluorescent lamp in each luminescent region according to the vertical synchronizing signal of a display control device and the temperature signal from the temperature detector; a lamp drive controller in the inverter circuit determining to turn on/off the fluorescent lamp of each luminescent region in the backlight of the liquid crystal display panel with the timing signal. The turn-on signal of each fluorescent lamp is generated and subsequently delayed by the inverter circuit according to the liquid crystal response in accord with the temperature dependency in each luminescent region.

10 Claims, 12 Drawing Sheets

LIQUID CRYSTAL DISPLAY DEVICE

BACKGROUND OF THE INVENTION

1. Field of the Invention

The invention relates to a liquid crystal display device, and more particularly to a liquid crystal display device and driving method.

2. Description of the Related Art

Liquid crystal display devices, with the characteristics of higher pixel resolution, higher display quality, lighter weights, thinner sizes, lower operation voltage, as well as low power consumption, are used in a wide variety of commercial applications, including cell-phones and digital cameras for small screen display panels, and large screen televisions exceeding 40 inches.

The liquid crystal display devices have the common feature of consisting of two (a pair of) substrates with one transparent glass substrate at least, sandwiching a liquid crystal material therebetween. The transmittance/interception of light is relative to the direction of the liquid crystal with a voltage applying thereto. The light transmitting/blocking state of a specific pixel is corresponding to a selective voltage applied across the transparent conductive layer (between the pixel electrode formed on the thin-film transistor (TFT) substrate module and the opposite electrode formed on the other substrate module) on the two substrate-models of the liquid crystal display panels.

Research and development focusing on liquid crystal display devices having lighter weights, thinner sizes, lower operation voltage, low power consumption, and display quality improvement have been undertaken to displace cathode-ray tube (CRT) as the most commonly used display device. Recent developments have led to the development of liquid crystal material and the improvement of a driving method thereof, which can meet high quality display requirements.

The cathode-ray tube uses an impulse-type light illumination by scanning of an electron gun, while the liquid crystal display device uses a hold-type light illumination with a plurality of linear lamps, such as fluorescent lamps, behind the liquid crystal display panel, resulting in sub par display performance for moving images as compared to the cathode-ray tube.

Because human eyes have integration time, blur phenomenon occurs when eyes focus on light emitted from a specific position of an object in the image projected onto the retina of the eye during a frame period. The contour of a moving object trailing an afterimage may be perceived in accordance with the mismatch phenomenon of the movement due to the motion blur effect.

Thus, displaying for a hold-type liquid crystal display device results in motion blur with respect to the aforementioned contour blur or called contour aliasing. Additionally, the animation quality deteriorates due to the ghost phenomenon caused by the interpolated position between the image of the preceding and succeeding frames. Such that the phenomenon of motion blurs and ghosts are generally referred to as edge-blurs.

Recently, research has led to reducing edge-blur and improving the display quality of animation for liquid crystal display devices as Jpn. Pat. Appln. Kokai Publication No. 11-202286.

FIGS. 1 and 2 are block diagrams, with FIG. 1 illustrating a liquid crystal display device for improving the display quality of animation by dividing a plurality of luminescent regions along the display of the vertical scan and FIG. 2 illustrating an illumination unit in FIG. 1 disclosed in patent reference 1.

As shown in FIG. 1, the liquid crystal display device comprises a liquid crystal display panel 100, a driving unit 200, a backlight unit 300, an inverter circuit 400, and a display control device 500. The driving unit 200 drives each pixel arranged in a matrix on the liquid crystal display panel 100. The backlight unit 300 in the back of the liquid crystal display panel 100 is divided into a plurality of luminescent regions, for instance, four regions in FIG. 1, 310, 320, 330, and 340, and installing fluorescent lamps 311, 321, 331, and 341, respectively. The inverter circuit 400 individually turns on/off the plurality of fluorescent lamps 311, 321, 331, and 341. The display control device 500 controls the driving unit 200 and the inverter circuit 400.

The backlight module is used as the backlight unit 300 of the liquid crystal display panel 100. The plurality of luminescent regions 310, 320, 330 and 340 are divided into a plurality of strip regions for the direction of vertical scanning. The fluorescent lamps 311, 321, 331, and 341 in each luminescent region individually illuminate the region where the liquid crystal display panel corresponds to the luminescent regions. In addition, a lamp reflector 350 disposed inside the backlight unit 300 for reflecting the light from a fluorescent lamp to the liquid crystal display panel 100, and an optical sheet 360 is disposed on the backlight unit 300 for uniform the light The image-writing signal of the liquid crystal display panel 100 is inputted through the driving unit 200 from the display control device 500. In addition, lighting the fluorescent lamp disposed in each luminescent region inside the backlight unit 300 is controlled by the luminescence control signal inputted by the display control device 500 through the inverter circuit 400.

As shown in FIG. 2, the illumination unit comprises a backlight unit 300, an inverter circuit 400, a divide counter 510, and a shift register 520. The divide counter 510 and the shift register 520 are disposed in the display control device 500 shown in FIG. 1, wherein the divide counter 510 divides the scanning shift clock, and then outputs the signal of dividing frequency to the inverter circuit 400 with the shift register 520 synchronizing with the scanning timing signal.

Inverters 401, 402, 403 and 404, each respectively driving the corresponding fluorescent lamps 311, 321, 331 and 341 in each of the luminescent regions 310, 320, 330 and 340, are disposed in the inverter circuit 400. In addition, the signal of dividing frequency according to the shift register 520 is inputted to inverters 401, 402, 403 and 404 sequentially, and then, the fluorescent lamps 311, 321, 331 and 341 and sequentially turned on by the timing of delaying only for a predetermined time from the vertical signal (image-writing signal) inputted from the liquid crystal display panel.

FIG. 3 is a timing chart explanatory of the liquid crystal response for the image-writing signal, the timing of lighting the fluorescent lamps, and the visible image perceived by the liquid crystal display observers for the liquid crystal display device shown in FIG. 2. The first timing chart in FIG. 3 illustrates the frame signal, the second chart is the image-writing signal which inputted to the pixel of the $n_{th}$ vertical line of the liquid crystal display panel, the third chart is the liquid crystal response time regarding the image-writing signal inputted to the pixel of the $n_{th}$ vertical line, the fourth chart is the on/off signal of the fluorescent lamps in the luminescent regions corresponding to the pixels of the $n_{th}$ vertical line, and the fifth chart is the visible image perceived from the concerning pixels by the observer.

When the voltage applied to the liquid crystal changes, the direction of the liquid crystal and the brightness of the pixels are correspondingly modified. At this time, the timing of the liquid crystal response is the delay of the timing of the change in the applied voltage for a predetermined time. Therefore, the change of the brightness is perceived by the observer in the process that the liquid crystal is changed from the state of a black display to the state of a white display when the fluorescent lamp is turned on according to the same timing as the input timing of the image-writing signal of the white display signal. On the contrary, the observer distinguishes the difference of the brightness when the liquid crystal is changed from the state of a white display to the state of a black display and the fluorescent lamp is turned off according to the same timing as the input timing of the image-writing signal of the black display signal. Additionally, the change of the brightness corresponding to the liquid crystal response is regarded as a result of edge-blur of the animation.

The change process of the liquid crystal response may not be perceived by the observer if it is assumed that the way of turning on and turning off of the fluorescent lamp is periodically after a predetermined time passed from rewriting the image signal for each frame period as shown in the fourth timing chart of FIG. 3. Thereafter, the edge-blur in the animation displayed may be suppressed and the lifelike quality of the animation may be provided.

In addition, the technology for improving the characteristics of the animation by utilizing an impulse-type manner for the image display of the hold-type liquid crystal display is also provided, for example, the method of interpolating black data between frames, the blocking method of blinking the backlight during a frame period, or, the scanning backlight method of sequentially blinking the backlight by way of area light during the period of the vertical scanning in one frame.

However, it is necessary for the inverters of the related art shown in FIG. 2 to be disposed in each luminescent region for constructing circuits individually, generating the timing signals in the plurality of luminescent regions, respectively.

Moreover, it is difficult for the related art to improve upon animation quality without concerning the liquid crystal response in accord with temperature dependency, even though the liquid crystal response changes with different liquid crystal temperature.

BRIEF SUMMARY OF THE INVENTION

Accordingly, an embodiment of the invention provides a liquid crystal device which is able to control the illuminating state of the fluorescent lamps disposed respectively in the plurality of luminescent regions with one single inverter, and to reduce the edge-blur of animation due to the liquid crystal response in accord with temperature dependency.

To achieve these advantages and solve such problems in accordance with the purpose of the present invention, as first embodied and described hereafter, a liquid crystal display device according to the present invention includes a liquid crystal display panel, a liquid crystal display control unit, an illumination unit, and an inverter circuit. The liquid crystal display panel has a plurality of pixels arranged to the intersections of a plurality of vertical and horizontal scan lines forming a matrix display, and respectively connected to a plurality of switches. The liquid crystal display control unit comprises a vertical driving circuit and a horizontal driving circuit, wherein the vertical driving circuit scans a display frame with a frame cycle, selects the plurality of the vertical scan lines sequentially, turns on the switches connected to the vertical scan lines, and subsequently selects the pixels thereon, and wherein the horizontal driving circuit synchronizes with the scan of the frame cycle and outputs the image signals to the pixels on the selected lines through the switches. The illumination unit illuminates the liquid crystal display panel according to a plurality of divided luminescent regions along the vertical scan lines. The inverter circuit successively illuminates the luminescent regions along the vertical scan lines while receiving and delaying the vertical synchronizing signal outputted from the liquid crystal display control unit synchronizing with the scan of the vertical scan lines. In addition, the inverter circuit further comprises a phase synchronous signal generator, generating a timing signal to determine the delay time of each luminescent region according to the vertical synchronizing signal of the inverter circuit.

For example, the luminescent regions of the liquid crystal display device are divided into n regions wherein n is an integer more than 2 and the phase synchronous signal generator comprises a turn-on timing circuit corresponding to a first luminescent region. Further, the phase synchronous signal generator comprises turn-on timing circuits and turn-off timing circuits connecting in series and respectively corresponding to the second and the subsequent luminescent regions. The timing signal synchronizing with the vertical synchronizing signal is inputted to the turn-on timing circuit of the first luminescent region to provide the turn-on timing signals corresponding to each luminescent region. In the meantime, the turn-on timing circuit corresponding to the $k_{th}$ (k=1, 2 . . . n−1) luminescent region is connected to the turn-off timing circuit corresponding to the $(k+1)_{th}$ luminescent region. Specifically, the turn-off timing circuit corresponding to the $(k+1)_{th}$ luminescent region receives the input signal from the turn-on timing circuit corresponding to the $k_{th}$ luminescent region to delay the timing signal of the turn-on circuit for illuminating the $(k+1)_{th}$ luminescent region.

In another embodiment of the present invention, a liquid crystal display device includes a liquid crystal display panel, a liquid crystal display control unit, an illumination unit, and an inverter circuit. The liquid crystal display panel comprises a plurality of pixels arranged to the intersections of a plurality of vertical and horizontal scan lines forming a matrix display. The liquid crystal display control unit comprises a vertical driving circuit and a horizontal driving circuit, wherein the vertical driving circuit scans a display frame with a frame cycle, selects the plurality of the vertical scan lines sequentially, turns on the switches connected to the vertical scan lines, and subsequently selects the pixels thereon, and wherein the horizontal driving circuit synchronizes with the scan of the frame cycle and writes the image signals to the pixels on the selected lines through the switches. The illumination unit illuminates the liquid crystal display panel according to a plurality of divided luminescent regions along the vertical scan lines. The inverter circuit comprises a temperature detector, a phase synchronous signal generator, and a lamp drive controller. The temperature detector detects the temperature of the liquid crystal display panel to generate a temperature signal. The phase synchronous signal generator receives the vertical synchronizing signal and generates a timing signal according the temperature signal to determine the illumination time of each luminescent region. The lamp drive controller illuminates the illumination unit with the timing signal.

It is preferred that the inverter circuit is modified with the real temperature of the liquid crystal display panel according to the amplification rate from the temperature detector and the charge rate from the time constant of the phase synchronous signal generator.

For example, the temperature detector of the inverter circuit comprises a temperature sensor and an operational amplifier for amplifying the electric signal corresponding to the change of the resistance from the temperature sensor, and generating the temperature signal.

Additionally, the phase synchronous signal generator further comprises a temperature timing circuit for synchronizing with the vertical synchronizing signal based on the temperature signal and the vertical synchronizing signal from the temperature detector, and generating a temperature timing signal with the pulse width corresponding to the temperature signal.

It is preferred that the luminescent regions are divided into n (n is an integer more than 2) regions, and the phase synchronous signal generator comprises a turn-on timing circuit corresponding to a first luminescent region. Further, the phase synchronous signal generator comprises turn-on timing circuits and turn-off timing circuits connecting in series and respectively corresponding to the second and the subsequent luminescent regions. The temperature timing signal synchronizing with the vertical synchronizing signal is inputted to the turn-on timing circuit of the first luminescent region to provide the turn-on timing signals corresponding to each luminescent region. Then the turn-on timing circuit corresponding to the $k_{th}$ (k=1, 2 . . . n−1) luminescent region is connected to the turn-off timing circuit corresponding to the $(k+1)_{th}$ luminescent region. Specifically, the turn-off timing circuit corresponding to the $(k+1)_{th}$ luminescent region receives the input signal from the turn-on timing circuit corresponding to the $k_{th}$ luminescent region to delay the timing signal of the turn-on circuit for illuminating the $(k+1)_{th}$ luminescent region.

According to a first embodiment, it is possible to control the timing of illuminating the luminescent regions of the backlight by only inputting the vertical signal of the liquid crystal display control unit to one single inverter circuit. Therefore, it is unnecessary to dispose a plurality of inverter circuits corresponding to each of the luminescent regions.

According to another embodiment, because the backlight is illuminated according to the proper timing corresponding to the temperature of the liquid crystal display panel detected by the temperature sensor in the inverter circuit, the edge-blur perceived for animation may be reduced even if the temperature of the liquid crystal display panel is differed/changed.

In addition, when the temperature sensor is not on the liquid crystal display panel, the temperature signal may be generated by modifying with the real temperature of the liquid crystal display panel according to the amplification rate from the temperature detector and the charge rate from the time constant of the phase synchronous signal generator.

Notwithstanding, when considering the liquid crystal response in accord with temperature dependency, the delay of the liquid crystal response (on/off time, rising/falling time) compromising the display quality for animation of the liquid crystal display is associated with the temperature of the liquid crystal. Therefore, the related art mentioned above may not be able to reduce the edge-blur of the animation due to the variation of the liquid crystal response in accord with temperature dependency, though the edge-blur of the animation with a uniform temperature of the liquid crystal display panel may be reduced. Further, when considering temperature of the operational environment, the operational environment of the liquid crystal display may be a lower temperature or a higher temperature, such that the improvement of the edge-blur for animation may be insufficient.

FIG. 4 is a graph for illustrating the edge-blur of the animation from the liquid crystal response in accord with temperature dependency by way of showing the relation between the contrasts of the environments with two different temperatures T1, T2. In FIG. 4, the horizontal axis denotes the time (the millisecond: ms) measured from 0 relative to the timing of inputting white display signals to the pixel, and the vertical axis denotes the transparency rate concerning the light passing through the liquid crystal. Also, T1 is about 30° C., T2 is about 10° C., and the fluctuation of the temperatures of the environment ΔT is around 20° C.

As shown in FIG. 4, the liquid crystal response changes substantially in response to the variation of the temperature. The liquid crystal response under low temperature (T2) of the environment becomes gradual compared with the liquid crystal response under high temperature (T1) of the environment. The rising time slope indicates the period of the transparency rate changing from 10% to 90%, the rising time slope under temperature T1 of the environment is about 4 ms, the rising time slope under temperature T2 of the environment is about 12 ms, and consequently, the liquid crystal response increases by three.

Thus, when the white display signal is inputted to the pixel in a state of black display, the liquid crystal response speed differs in accordance with the temperature of the environment of the liquid crystal display panel. For example, if T1 is the temperature of the operational environment of the liquid crystal display in the summer, and T2 is the temperature of the operational environment of the liquid crystal display in the winter, the liquid crystal response in the summer and in the winter would be different, and the quality of the animation may be changed in response to the seasons. Moreover, the edge-blur of the animation may be changed according to the variation of the temperature of the liquid crystal from the heat in the liquid crystal display device and so forth, though the temperature of the operational environment of the liquid crystal display (indoor temperature etc.) may remain uniform. In addition, when the black display signal is inputted to the pixel in a state of black display, the liquid crystal response speed will also be different depending upon the temperature of the environment where the liquid crystal display panel is placed.

FIGS. 5A and 5B are the timing charts explanatory of the influence on the quality of the perceived visible image with different temperatures of the liquid crystal according to the related art shown in FIG. 2 where the edge-blur of the animation is reduced. From the example shown in the figure, the illuminating state of the fluorescent lamp is controlled so that the edge-blur of the animation may be reduced at the temperature T1 (FIG. 5A) of the liquid crystal, and the signal of turning on and turning off the fluorescent lamps in each luminescent region is delayed with respect to the timing of delaying the vertical signal of the liquid crystal display panel only for a predetermined time.

Referring to FIG. 4, because the response is slow for low temperatures of the liquid crystal, the liquid crystal response during lower temperature T2 (FIG. 5B) of the liquid crystal, as shown in the third timing chart, becomes more gradual in rising (and falling) when compared with temperature T1 of the liquid crystal. Therefore, when a fluorescent lamp is turned on according to the same timing shown in FIG. 5A, for a gradual liquid crystal response, the variation in the process of the liquid crystal response is perceived by the viewer, and as a result, the animation is perceived as an edge-blurred image.

In other words, the quality of the animation according to the related art may have been improved, however, when the temperature of the liquid crystal is differed or changed; the edge-blur for animation may be generated. It is possible to solve such a problem by maintaining the temperature of the liquid crystal at a desirable uniform temperature, but an external heat source such as heaters and accompanying driving circuits, etc. are required. As a consequence, the manufacturing of the liquid crystal display device would become more complicated and cost and power consumption would increase.

The liquid crystal display device of the present invention constructs the delay of the illuminating signal of the backlight in each luminescent region, and corresponds the delay with the liquid crystal response in accord with temperature dependency.

A detailed description of the embodiments of the liquid crystal display device of the present invention along with operation of the device is given in the following with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 6:
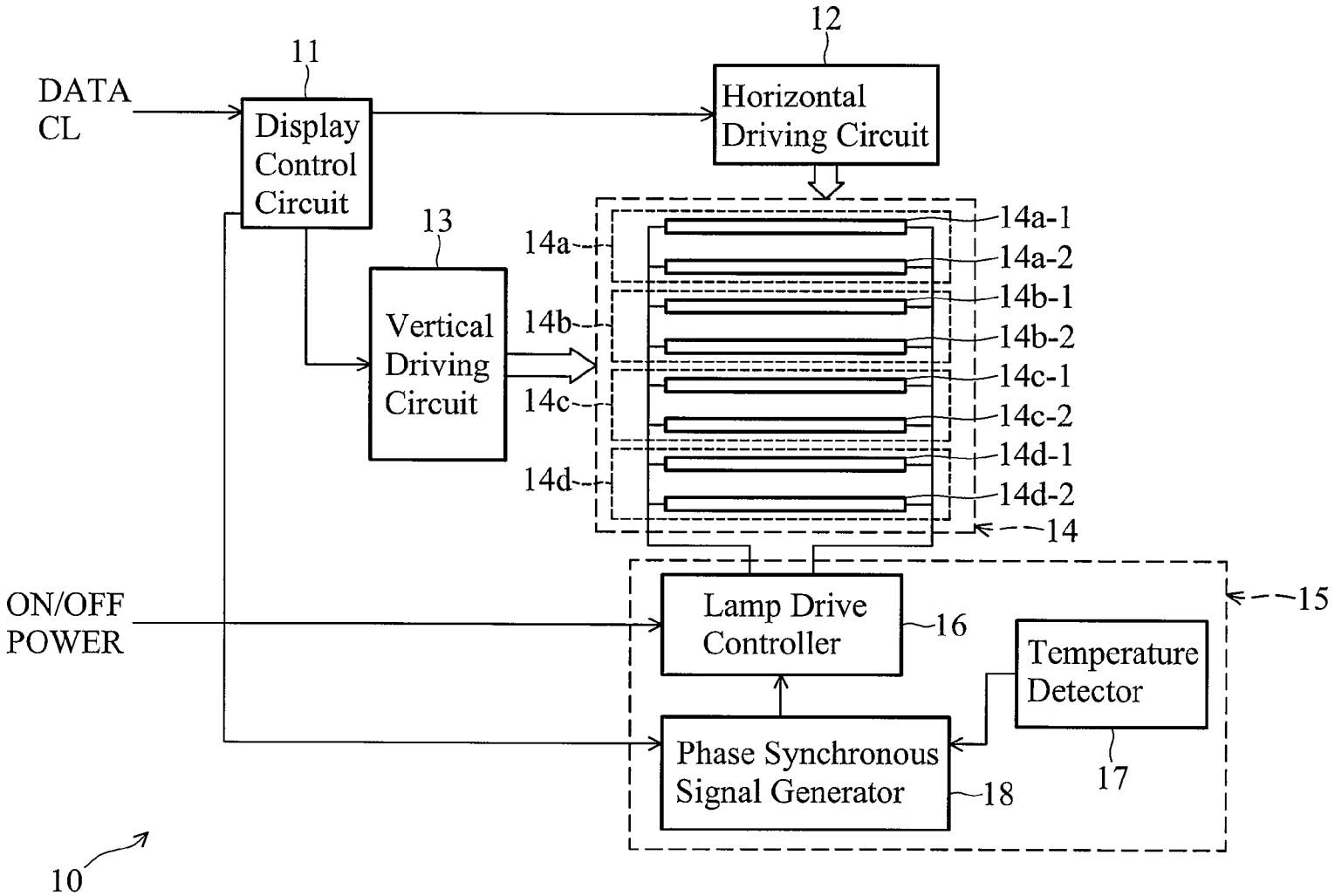
FIG. 6 is a block diagram illustrating a liquid crystal display device according to the present invention.

FIG. 6 is a block diagram illustrating a liquid crystal display device according to the present invention. The liquid crystal display device 10 comprises a liquid crystal display control circuit 11, a horizontal driving circuit 12, a vertical driving circuit 13, a liquid crystal display panel 14, an inverter circuit 15, and an illumination unit disposed behind the liquid crystal display panel 14 defining 14*a*-1 and 14*a*-2, 14*b*-1 and 14*b*-2, 14*c*-1 and 14*c*-2, 14*d*-1 and 14*d*-2, hereafter assumed as 14*a*-1 and 14*a*-2~14*d*-1 and 14*d*-2.

The pixels on the liquid crystal display panel 14 are arranged to the intersections of vertical and horizontal scan lines forming a matrix display, and connected to switches respectively (not shown).

A liquid crystal display control unit comprises the liquid crystal display control circuit 11, the horizontal driving circuit 12, and the vertical driving circuit 13. Wherein the vertical driving circuit 13 selects the pixels on the lines by driving the switches connected to the pixels, and scans a display frame with a frame cycle. And, the horizontal driving circuit 12 synchronizes with the scan of a frame cycle and writes the image signals to the pixels on the selected lines.

The inverter circuits 15 successively illuminates the divided luminescent regions in the back of the liquid crystal display panel 14 along the vertical scan lines while receiving and delaying the vertical synchronizing signal outputted from the liquid crystal display control unit. The inverter circuit 15 comprises a phase synchronous signal generator 18 for generating a timing signal to determine the delay time of each luminescent region based on the vertical synchronizing signal.

The inverter circuit 15 comprises a lamp drive controller 16, a temperature detector 17, and a phase synchronous signal generator 18. In addition, the back of the liquid crystal display panel 14 is divided into 4 luminescent regions 14*a*, 14*b*, 14*c*, and 14*d*, and the fluorescent lamps 14*a*-1 and 14*a*-2~14*d*-1 and 14*d*-2 are mounted in each luminescent region to construct the backlight in each luminescent region.

With reference to the liquid crystal display device disclosed in prior art, it is necessary to dispose a plurality of inverters in a plurality of luminescent regions respectively. In contrast, the liquid crystal display device of the present invention requires just one single inverter to control the illuminating states of the fluorescent lamps in the plurality of luminescent regions. Thus, in reference to the present invention as compared to prior art, electronic components are decreased and miniaturization of the substrate may be achieved.

The display control circuit 11 outputs the signal for turning on/off the pixels to the horizontal driving circuit 12 and the vertical driving circuit 13 according to the inputted image data, and outputs the vertical synchronizing signal to the phase synchronous signal generator 18 in the inverter circuit 15.

In the inverter circuit 15, the temperature detector 17 comprises a sensor (not shown) for detecting the temperature of the liquid crystal display panel, and outputs the signal corresponding to the detected temperature of the liquid crystal display panel to the phase synchronous signal generator 18.

The phase synchronous signal generator 18 determines the timing of turning on/off each fluorescent lamps in every luminescent region according to the vertical synchronizing signal of the liquid crystal display control circuit 11 and the temperature of the liquid crystal from the temperature detector 17, and outputs the timing signal to the lamp drive controller 16 of the inverter circuit 15. The backlight module of the liquid crystal display panel 14 is divided into the luminescent regions, and the lamp drive controller 16 controls turning on/off the backlight (fluorescent lamps) in each luminescent region based on the aforementioned timing signal. That is, the timing signal of each luminescent region generated in the inverter circuit 15, is an appropriately delayed signal that turns on each fluorescent lamp associated with the liquid crystal response in accord with temperature dependency.

Figure 7:
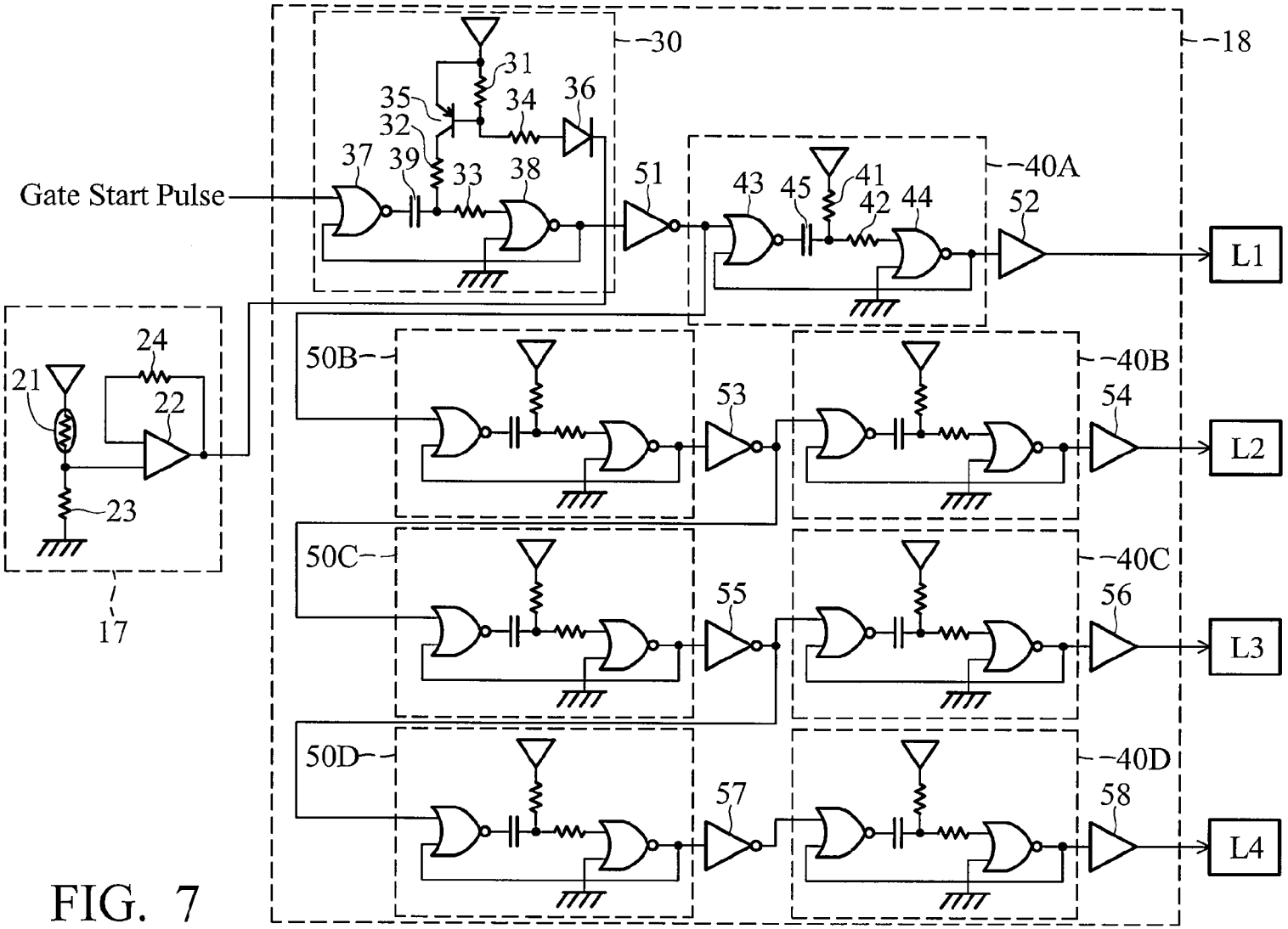
FIG. 7 is a block diagram illustrating the temperature detector and the phase synchronous signal generator of the liquid crystal display device according to the present invention.

FIG. 7 is a block diagram further illustrating the temperature detector 17 and the phase synchronous signal generator 18 shown in FIG. 6. The temperature detector 17 comprises a temperature sensor 21, an operational amplifier 22, and two registers 23 and 24. Moreover, the phase synchronous signal generator 18 comprises a temperature timing circuit 30 corresponding to the turn-on timing circuits 40A, 40B, 40C, and 40D of the luminescent regions 1, 2, 3, and 4 respectively, and corresponding to the turn-off timing circuits 50B, 50C, and 50D of the luminescent regions 2, 3, and 4 respectively.

The temperature detector 17 detects the temperature of the substrate, that is, the approximate environmental temperature of the liquid crystal display device, according to the temperature sensor 21, such as a negative thermally sensitive register, on the inverter substrate. Because the temperature information detected by the temperature sensor 21 is represented as a difference of the resistance of the temperature sensor 21, it is regarded as an electric signal in response to the resistance difference from the temperature, then inputted to the amplifier device comprising the operational amplifier 22, and subsequently the signal regarding the temperature of the liquid crystal display panel is amplified and outputted as a signal of the temperature of the liquid crystal.

The temperature timing circuit 30 comprises four resistors 31, 32, 33 and 34, a transistor 35, a diode 36, two logical circuits 37 and 38, and a capacitor 39.

The temperature timing circuit 30 is a one shot multivibrator with an external input terminal. The temperature of the liquid crystal is inputted to the base terminal of the transistor 35, synchronized with the gate start pulse signal. Accordingly, the timing signal of the pulse width (depicted as $t_T$(T1) and $t_T$(T2) below) is outputted to correspond with the temperature detected by the temperature sensor 21. The timing of the generated signal is then determined by the charge and discharge constant of the resistor 32, the capacitor 39, and the logical circuits 37 and 38 comprising the NAND gates.

The turn-on timing circuits 40A corresponding to the luminescent region 1 comprises two resistors 41 and 42, two logical circuits 43 and 44, and a capacitors 45. The input terminal of the turn-on timing circuits 40A is connected to the temperature timing circuits 30 through a logical circuit 51, and the timing signal of the first luminescent region L1 is outputted through a logical circuit 52.

The turn-on timing circuits 40A, which is similar to the aforementioned temperature timing circuits 30, is a one shot multivibrator with an external input terminal. The external input signal of the turn-on timing circuits 40A is the output signal from the temperature timing circuits 30. Further, the turn-on timing circuit 40A generates the turn-on timing according to the logical circuits 43 and 44, the resistor 41, and the capacitor 45. Then, turn-on timing signal of the luminescent region 1 is produced.

The turn-on timing circuits 40B, 40C, and 40D, and the turn-off timing circuits 50B, 50C, and 50D, are formed as the same circuit structure as the turn-on timing circuits 40A. These turn-on timing circuits 40B, 40C, and 40D, through the logical circuits 53, 55, and 57, are connected with the turn-off timing circuits 50B, 50C, and 50D. The timing signal L2, L3 and L4 of the luminescent regions 2, 3, and 4 are produced from each output terminal of the turn-off timing circuits 50B, 50C, and 50D, through the logical circuits 54, 56, and 58.

That is to say, the turn-off timing circuit 50B of the luminescent region 2 regards the input signal from the turn-on timing circuit 40A of the luminescent region 1 as a trigger. The turn-off timing circuit 50C of the luminescent region 3 regards the input signal from the turn-on timing circuit 40B of the luminescent region 2 as a trigger. Furthermore, the turn-off timing circuit 50D of the luminescent region 4 regards the input signal from the turn-on timing circuit 40C of the luminescent region 3 as a trigger. Therefore, the operation is sequentially performed, and the signal regarding a predetermined delay ($t_V$) between the luminescent regions is generated.

Figure 8:
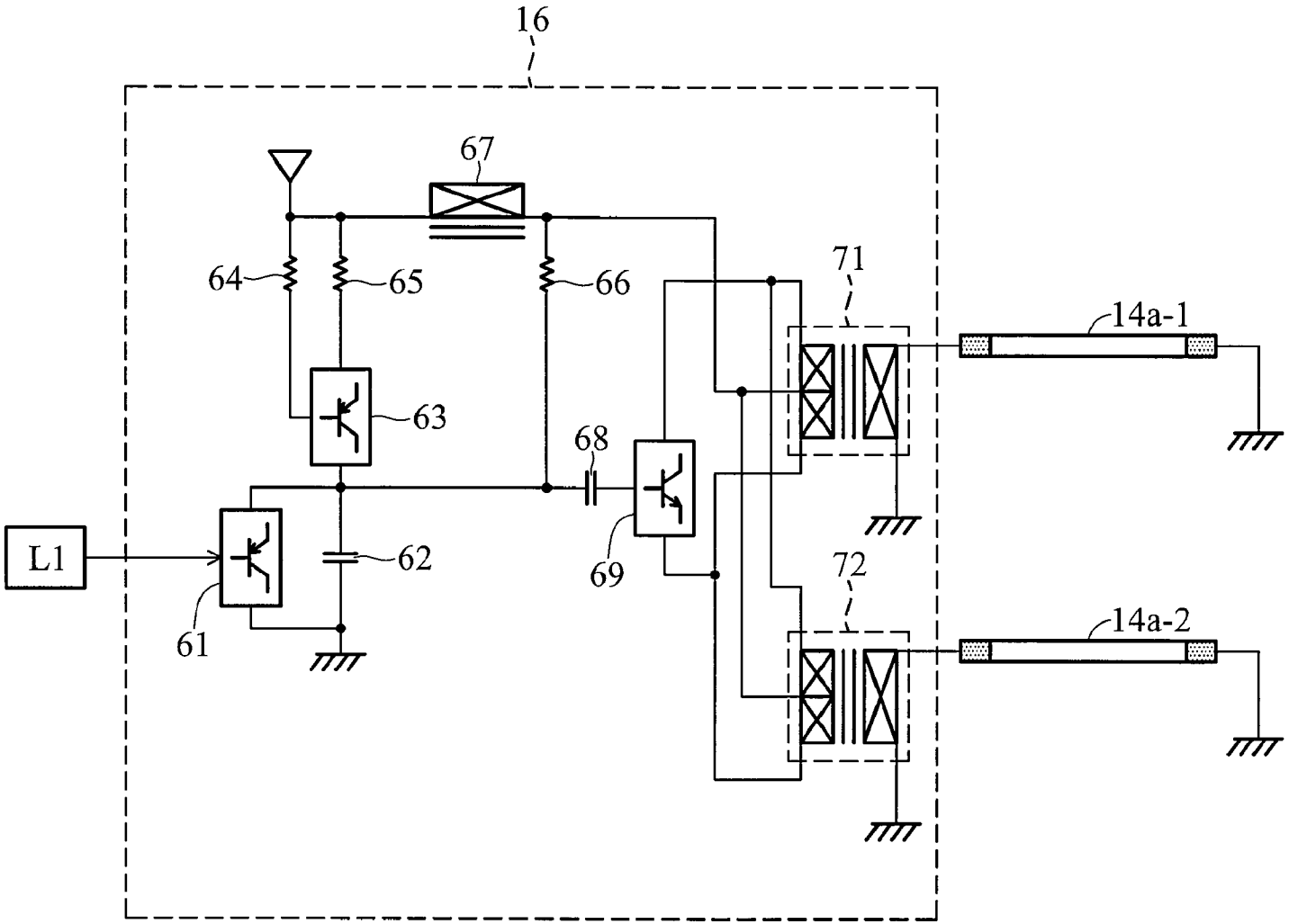
FIG. 8 is a block diagram illustrating the lamp drive controller according to the present invention.

FIG. 8 is a block diagram of the lamp drive controller 16 illustrated in FIG. 6. Only the lamp drive controller of the FIG. 8 corresponding to the luminescent region 1 is shown, but the lamp drive controllers corresponding to other luminescent regions are also similar. Moreover, though there are two fluorescent lamps 14*a*-1 and 14*a*-2 exhibited, the number of the fluorescent lamps disposed in each luminescent region may be increased or decreased.

The circuit illustrated in FIG. 8 comprises three transistors 61, 63 and 69, two capacitors 62 and 68, three resistors 64, 65 and 66, an excitation coil 67, and two high-voltage transformers for lamp driving 71 and 72. The circuit illustrated in FIG. 8 is a self-excited lamp drive circuit provided with the high-voltage transformers for lamp driving 71 and 72, and the fluorescent lamps 14*a*-1 and 14*a*-2, and accordingly, the circuit oscillates in a specific frequency for lighting the lamps.

The timing signal L1 of the luminescent region 1 specified in FIG. 7 is inputted to the transistor 61, and the fluorescent lamps 14*a*-1 and 14*a*-2 of the luminescent region 1 are turned on according to the timing affected by the vertical synchronizing signal and the temperature of the liquid crystal display panel. Alternatively, it is further possible to assume that the circuit may comprise separately excited lamp drive circuit.

Figure 9:
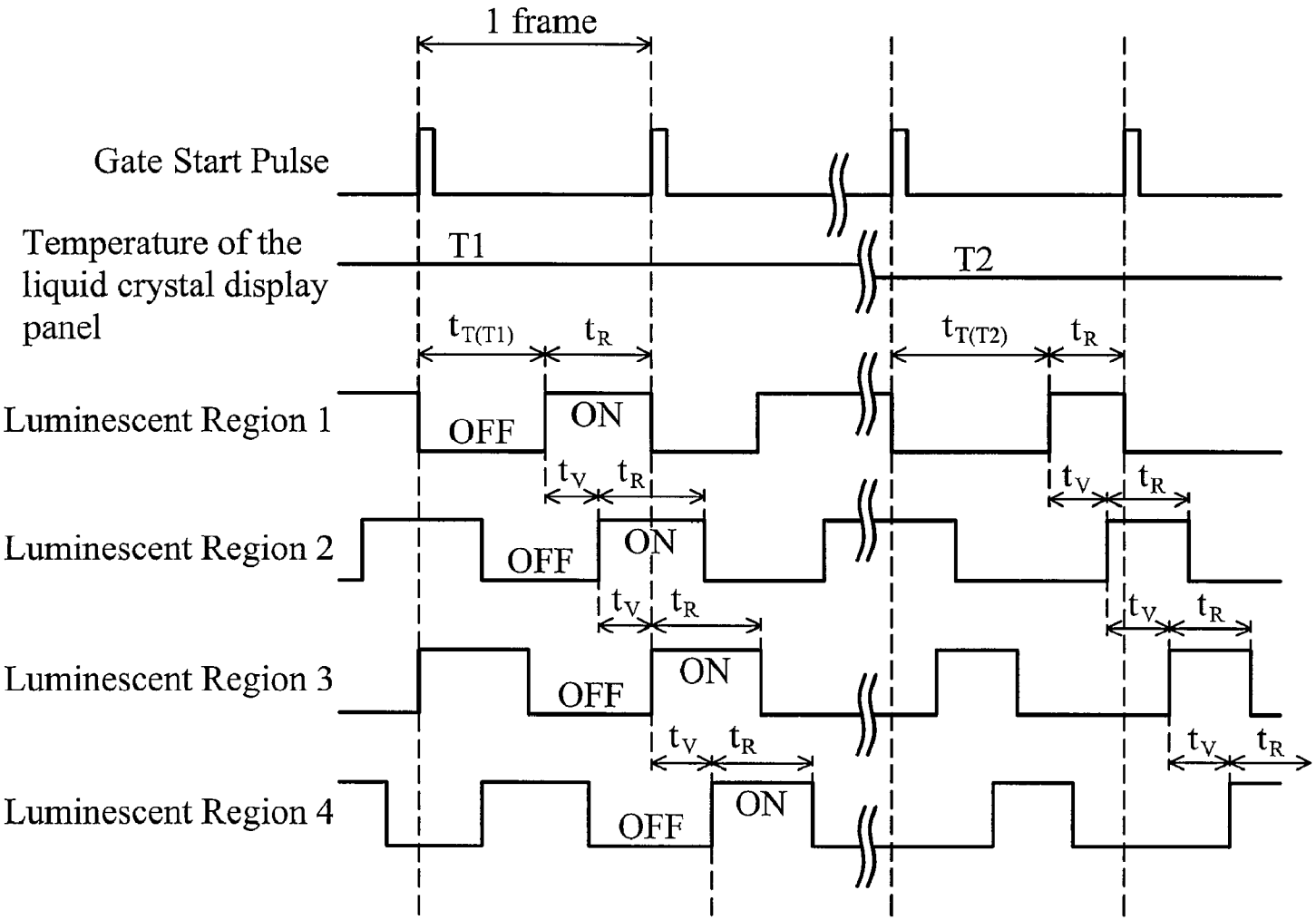
FIG. 9 is a timing chart explanatory of the turn-on timing of the luminescent regions 1, 2, 3 and 4, the timing of the gate start pulse signal, and the temperature of the liquid crystal display panel in the liquid crystal display device of the present invention.

FIG. 9 is a timing chart explanatory of the turn-on timing of the luminescent regions 1, 2, 3 and 4, the timing of the gate start pulse signal, and the temperature of the liquid crystal display panel in the liquid crystal display device of the present invention. The gate start pulse signal illustrated on the first timing chart of the figure is the input signal of the inverter circuit 15, and is the vertical synchronizing signal inputted to the phase synchronous signal generator 18 from the display control circuit 11.

As shown in FIG. 7, the temperature sensor 21 is disposed in the temperature detector 17 of the inverter circuit 15. The signal of the temperature of the liquid crystal from the temperature detector 17 is inputted to the temperature timing circuit 30 in the phase synchronous signal generator 18. The temperature timing circuit 30 is a gate start pulse signal synchronizing timing circuit. Based on the output signal from the temperature detector 17, the timing adjustment corresponding to the temperature of the liquid crystal display panel is provided in accordance with the synchronizing timing time $t_T$ from the gate start pulse signal, and then the adjusted timing signal is outputted.

That is to say, in FIG. 9, when the temperature of the liquid crystal display panel is T1 and is detected, the turn-off timing $t_T$(T1) illustrated in the timing chart of the luminescent region 1 is generated. When the temperature of the liquid crystal display panel becomes T2, similarly, the turn-off timing $t_T$(T2) illustrated in the luminescent region 1 is generated.

Referring back to FIG. 6, the inverter circuit 15 adjusts the turn-on timing according to the amplification rate from the temperature detector 17, and the charge rate from the time constant which is decided by resistor 32 and capacitor 39 of the temperature timing circuit 30. Therefore, the signal of the temperature of the liquid crystal may be generated even in the state that the temperature sensor 21 is not directly disposed on the liquid crystal display panel 14.

Figure 1:
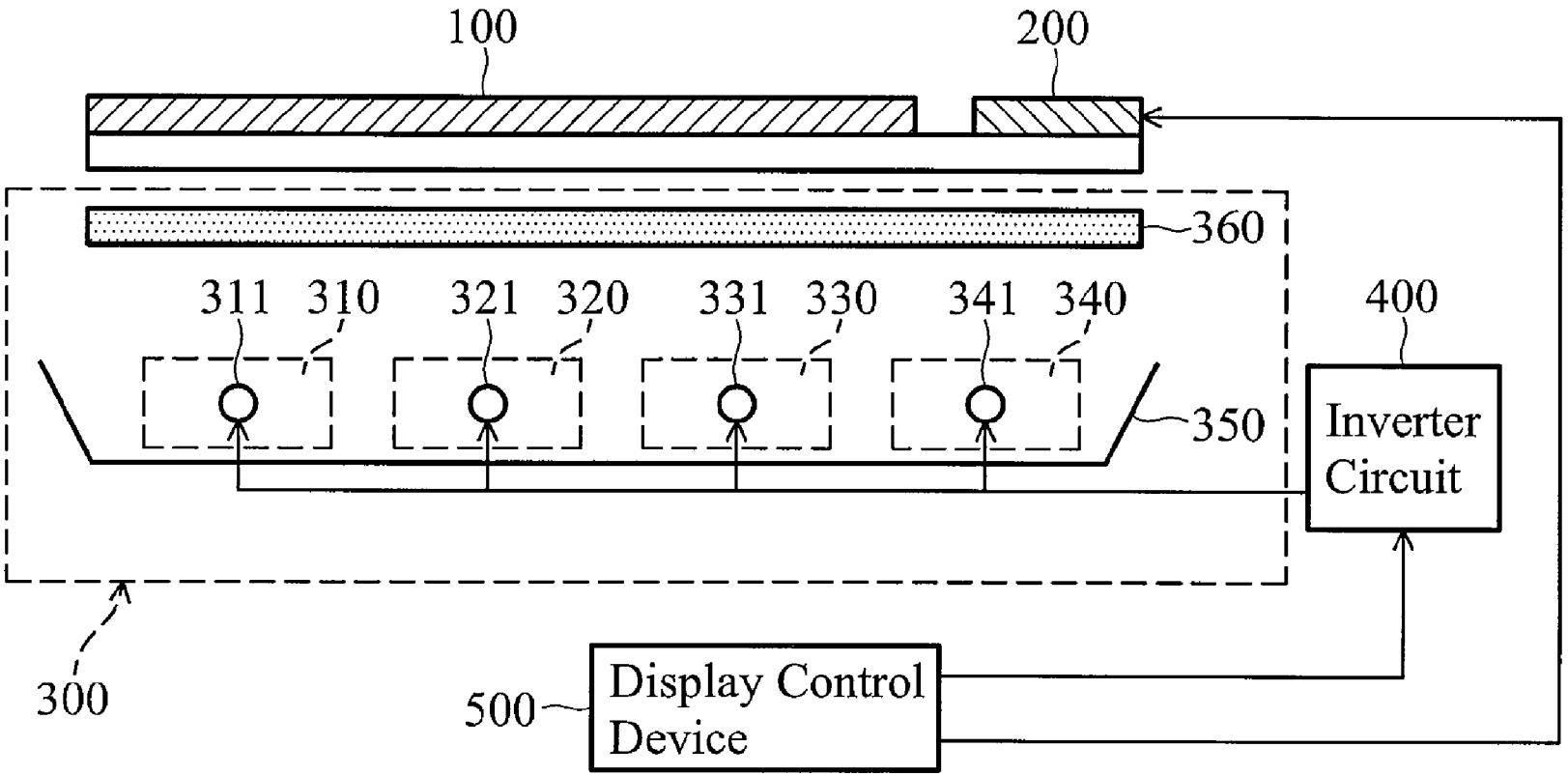
FIG. 1 ( RELATED ART )
FIG. 1 is a block diagrams illustrating a liquid crystal display device for improving the display quality of animation by dividing a plurality of luminescent regions along the display of the vertical scan.
Figure 2:
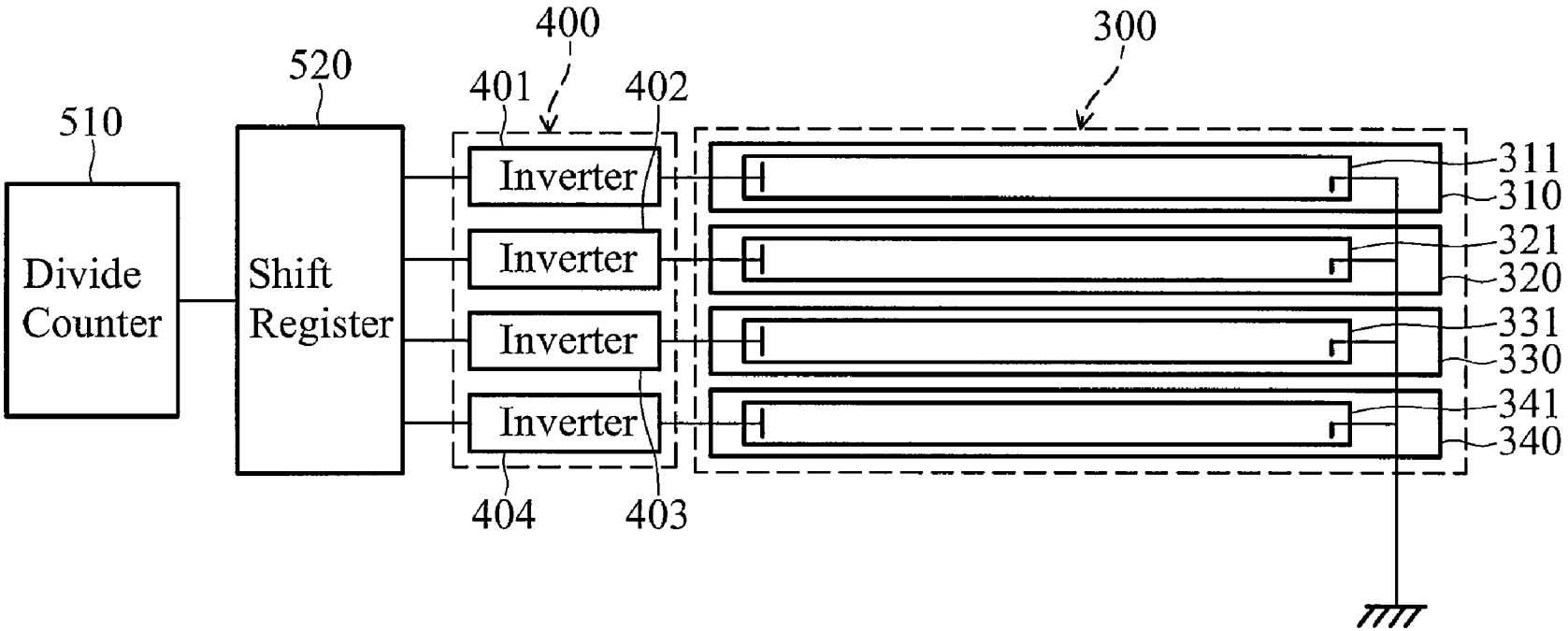
FIG. 2 ( RELATED ART )
FIG. 2 is a block diagrams illustrating an illumination unit shown in FIG. 1 disclosed in patent reference 1.
Figure 3:
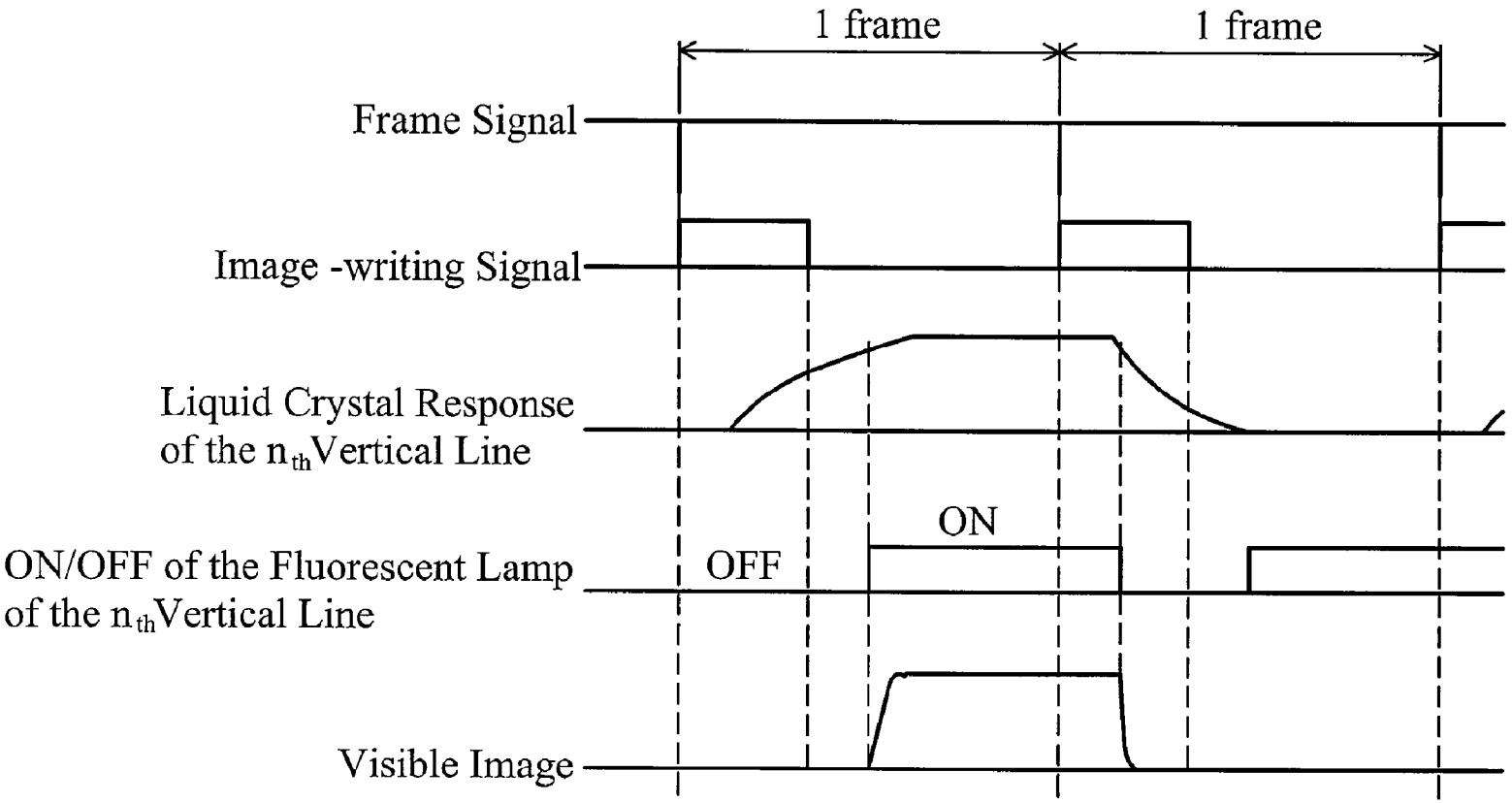
FIG. 3 ( RELATED ART )
FIG. 3 is a timing chart explanatory of the liquid crystal response for the image-writing signal, the timing of lighting the fluorescent lamps, and the visible image perceived by the observers in the liquid crystal display device illustrated in FIG. 2.
Figure 4:
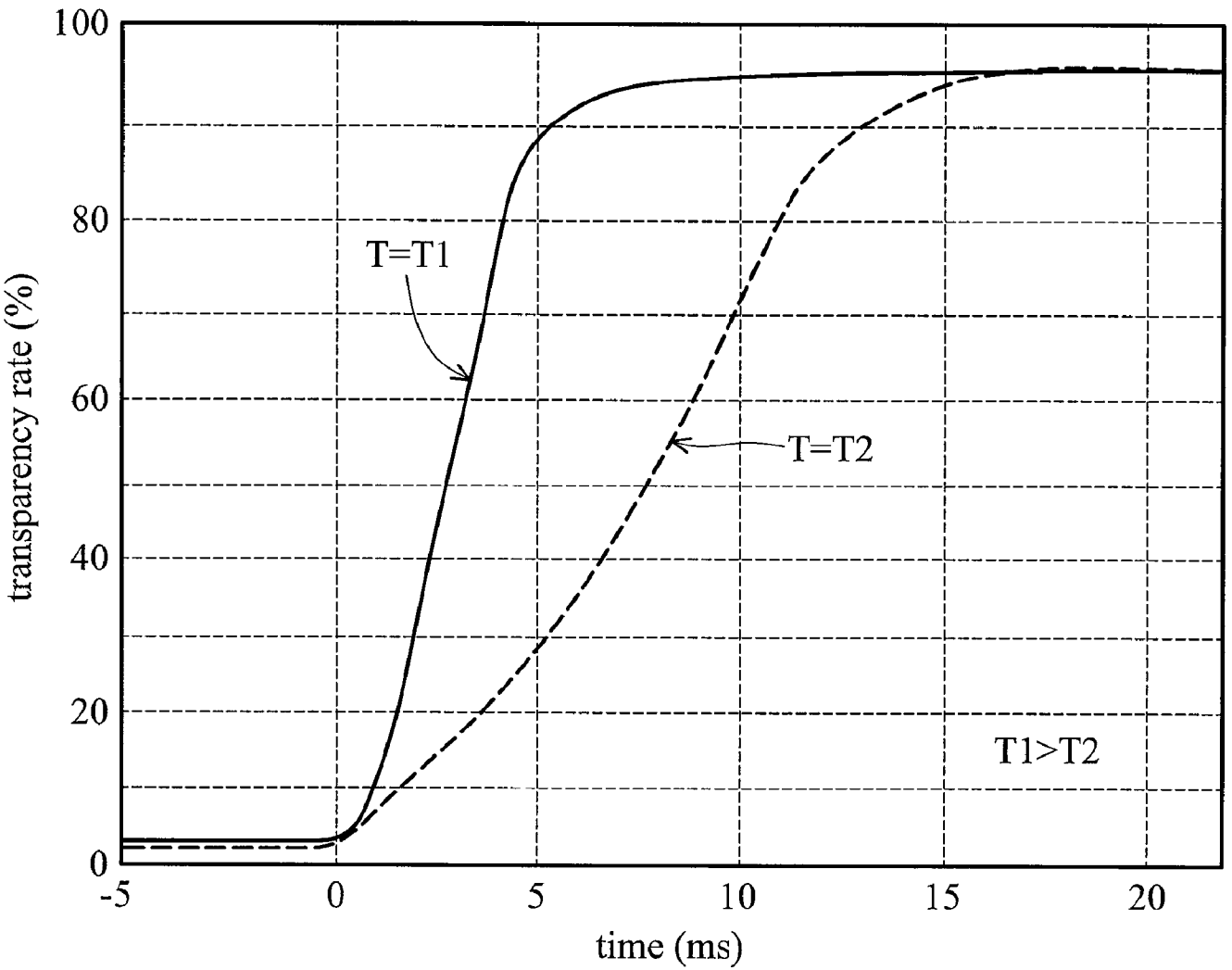
FIG. 4 ( RELATED ART )
FIG. 4 is a graph illustrating the liquid crystal response in accord with temperature dependency.
Figure 5A:
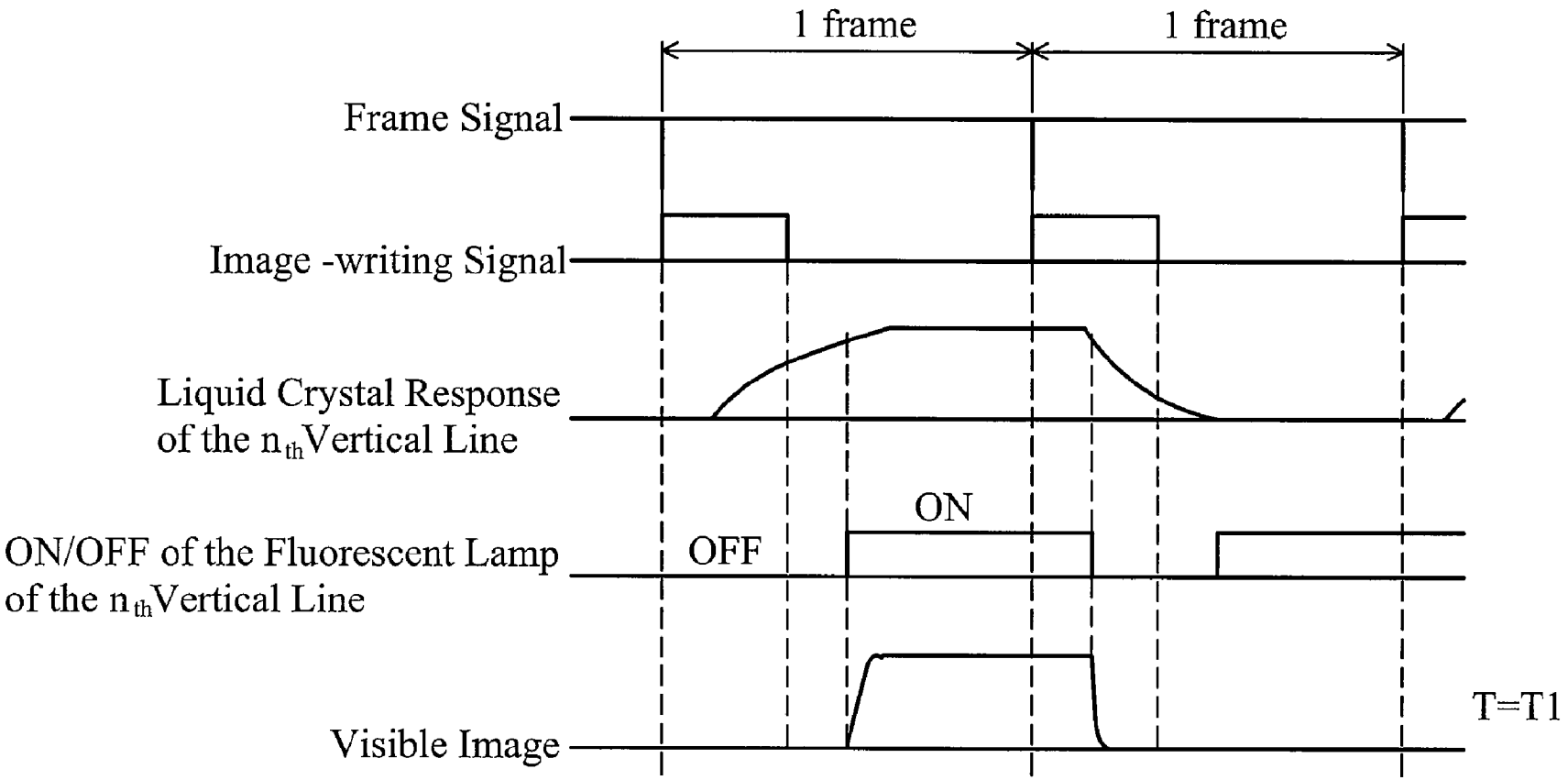
FIG. 5A ( RELATED ART )
FIGS. 5A and 5B are timing charts explanatory of the visible images with different temperatures of the liquid crystal.
Figure 5B:
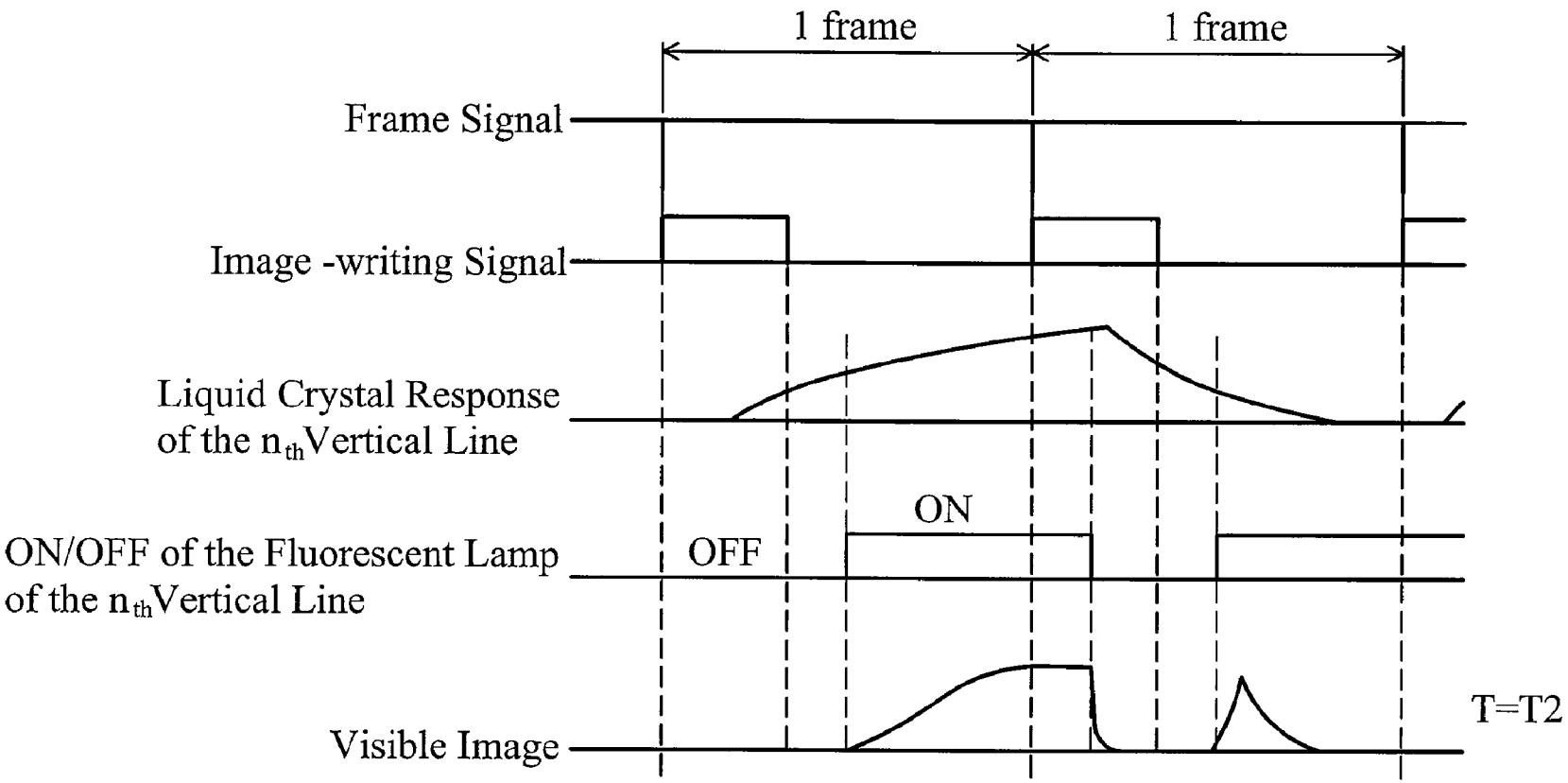
FIG. 5B ( RELATED ART )

In the liquid crystal display device 10 of the present invention, the positional relation between the liquid crystal display panel 14, the backlight disposed thereon, and the inverter circuit 15 is similar to the one illustrated in FIG. 1. The fluorescent lamps 14*a*-1 and 14*a*-2~14*d*-1 and 14*d*-2, which are the backlight, are arranged in parallel relationship to one another on the back of the liquid crystal display panel 14. Then, the inverter circuit 15 is disposed adjacent the backlight. In addition, the temperature detector 17 where the signal of the temperature of the liquid crystal is generated, is disposed in the inverter circuit 15 as shown in FIG. 6

There are many factors to decide the temperature of the liquid crystal, for example, the temperature of the environment of the liquid crystal display device 10, and heat generated by lighting the fluorescent lamps 14*a*-1 and 14*a*-2~14*d*-1 and 14*d*-2, which are regarded as the backlight. More specifically, heat from the backlight module is a key factor for changing the temperature of the liquid crystal. Thereby, it is assumed that the liquid crystal display device is designed to uniformly radiate heat from the backlight of the liquid crystal display panel to the outside environment.

Therefore, an environmental temperature of the inverter circuit 15, which is disposed adjacent to the backlight, changes along with the variation of the temperature from the liquid crystal display panel 14. Further, there is an extremely strong correlation between the changed environmental temperature and the variation of the temperature from the liquid crystal display panel 14. According to the embodiment of the present invention, as described above, in other words, it is possible to perform the temperature monitor of the liquid crystal display panel 14 by the temperature detector 17 disposed in the inverter circuit 15, without performing a complicated temperature measure procedure.

Referring to FIG. 9, the signal concerning the turn-on timing time $t_R$ of the luminescent region 1 is generated by the turn-on timing circuit 40A, and regarded as the timing signal L1 of luminescent region 1. Then the fluorescent lamps are turned on by inputting the timing signal L1 to the lamp drive controller 16. The turn-on timing circuit 40A, basically, is the same signal synchronizing circuit as the temperature timing circuit 30 and the turn-on timing time is $t_R$. Moreover, the turn-on timing circuits 40B, 40C, and 40D, corresponding to the luminescent region 2, 3, and 4, respectively also generate the same turn-on timing time $t_R$ as the turn-on timing circuit 40A.

Each of the turn-off timing time in the luminescent region 2, 3 and 4, is generated by the turn-off timing circuits 50B, 50C and 50D, respectively. Furthermore, the turn-off timing is irrelevant to the adjusted timing signal outputted from the temperature timing circuit 30. The turn-off timing of the luminescent region 2 delays the illumination time of the luminescent region 1 only by $t_V$, the turn-off timing of the luminescent region 3 delays the illumination time of the luminescent region 2 only by $t_V$, and consequently, the turn-off timing of the luminescent region 4 is generated by delaying the illumination time of the luminescent region 3 only by $t_V$. The timing signals L2, L3 and L4 are inputted to the lamp drive controller 16 for lighting the fluorescent lamps disposed in the luminescent regions 2, 3 and 4.

Thus, the luminescent regions 2, 3 and 4 are illuminated by receiving the delay that synchronizes with the gate start pulse of each frame, but among the timing parameters that decide the delays ($t_T$, $t_V$ and $t_R$), only parameter $t_T$ changes in accordance with the temperature of the liquid crystal display panel. The turn-on timing time $t_R$ and the turn-off timing $t_V$ of the luminescent regions 2, 3 and 4, both are fixed values depending on the vertical signal cycle of the liquid crystal display panel.

Figure 10:
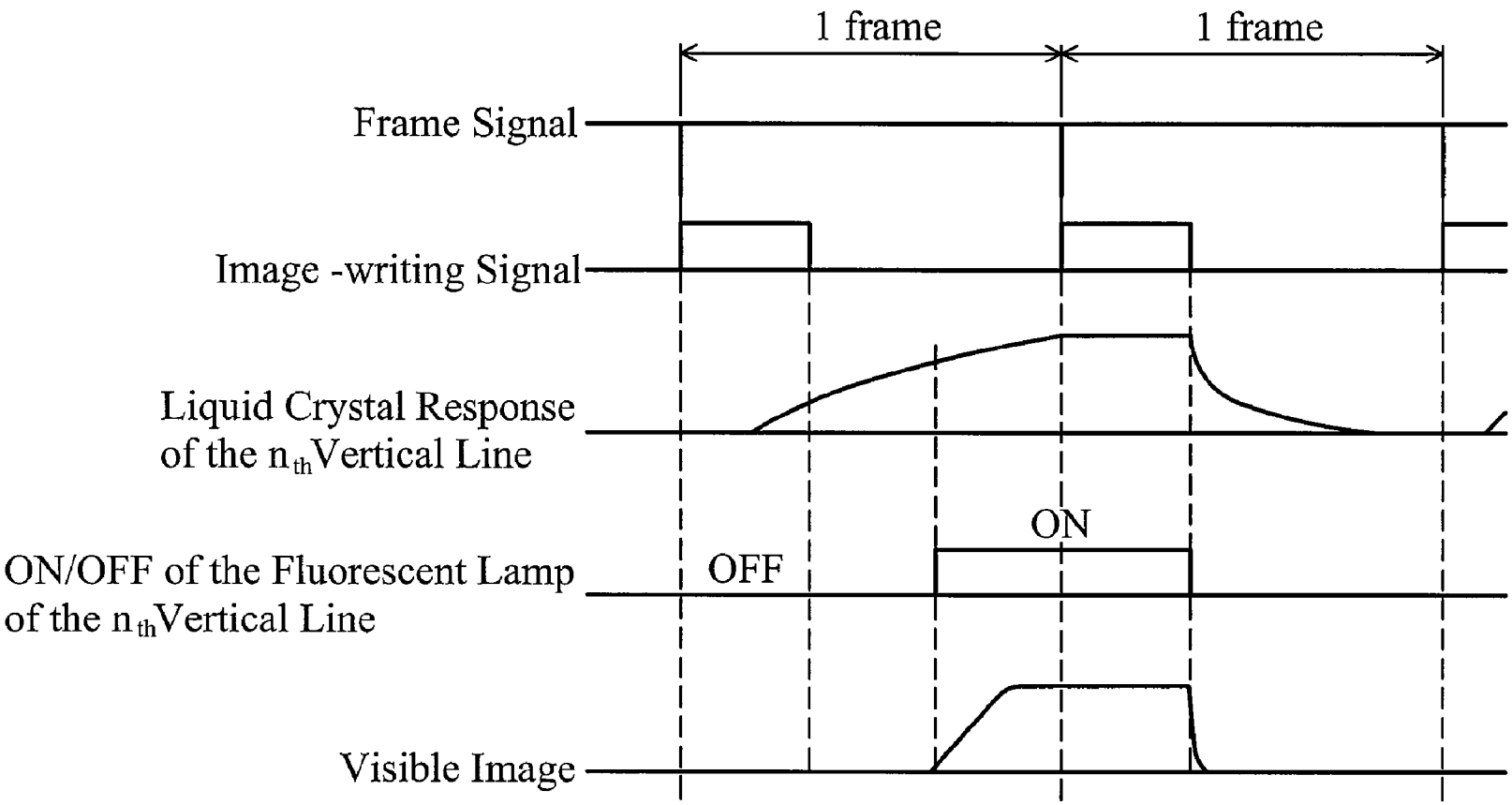
FIG. 10 is a timing chart explanatory of the state of perceiving the animation according to the liquid crystal display device of the present invention (relatively higher temperature)
Figure 11:
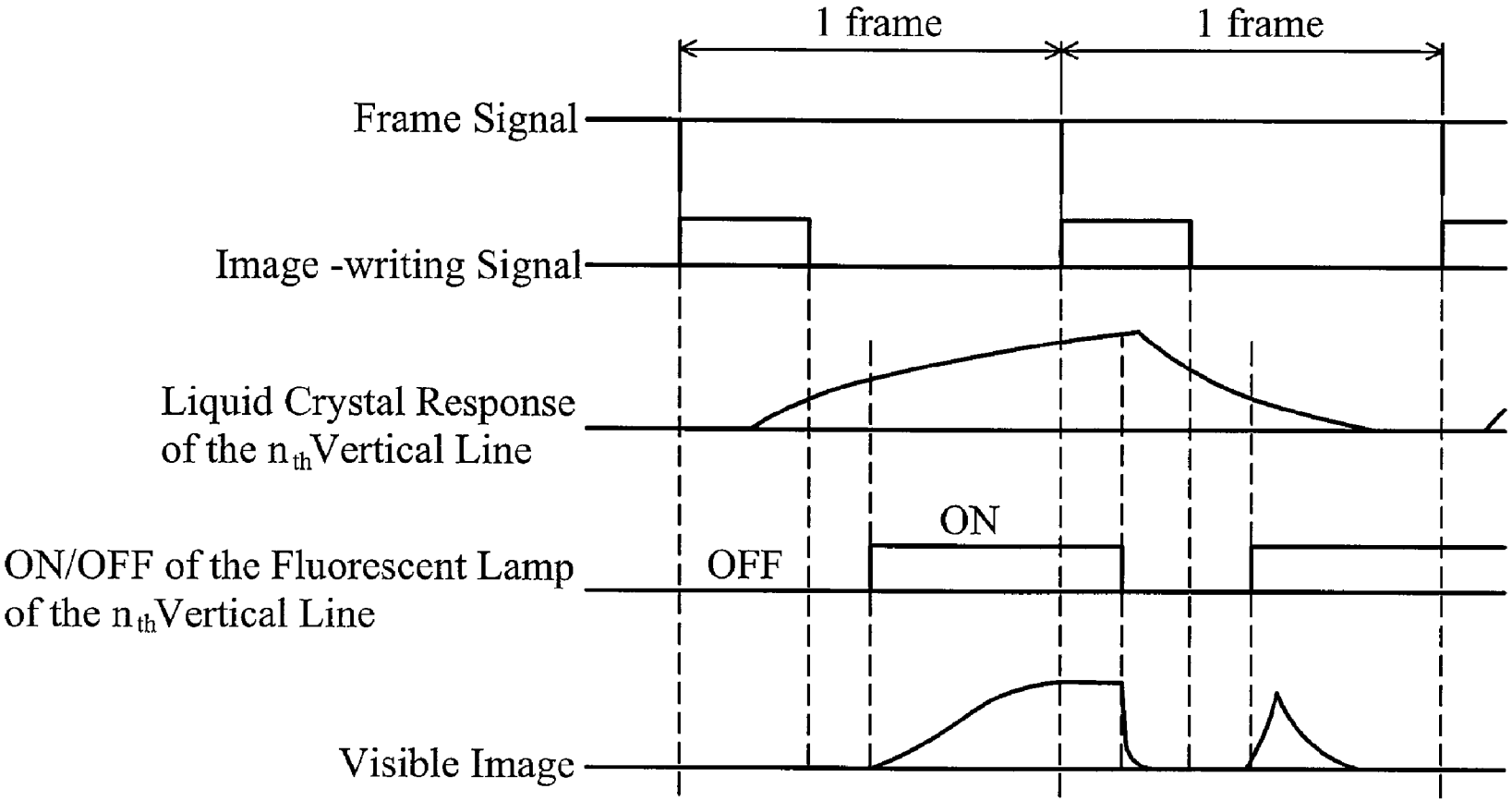
FIG. 11 is a timing chart explanatory of the state of perceiving the animation according to the liquid crystal display device of the present invention (relatively lower temperature).

FIGS. 10 and 11 are the timing charts explanatory of how the animation is perceived using the liquid crystal display device with the luminescent regions being turned on/off according to the timing illustrated in FIG. 9. In FIG. 10, the temperature of the liquid crystal display panel is a relatively higher temperature, and in the chart of FIG. 11, the temperature of the liquid crystal display panel is a relatively lower temperature.

As shown in FIGS. 10 and 11, though the liquid crystal response changes corresponding to the different temperature of the liquid crystal display panel, the turn-on/off timings (delays) of the fluorescent lamps according to the change of the liquid crystal response are appropriately adjusted. As a result, the changing process of the liquid crystal response is never perceived by the observer in any temperature change of the liquid crystal display panel. More particularly, the edge-blur for animation is reduced eliminating any relation with the temperature of the liquid crystal display panel, and improvement of animation quality is achieved.

The present invention provides the liquid crystal display device capable of controlling the illuminating state of the fluorescent lamps disposed in the plurality of the luminescent regions respectively with one single inverter, thus reducing edge-blur for animation resulting from the liquid crystal response in accord with temperature dependency.

While the invention has been described by way of example and in terms of the preferred embodiments, it is to be understood that the invention is not limited to the disclosed embodiments. To the contrary, it is intended to cover various modifications and similar arrangements. Therefore, the scope of the appended claims should be accorded the broadest interpretation so as to encompass all such modifications and similar arrangements.

What is claimed is:

1. A liquid crystal display device, comprising:

a liquid crystal display panel having a plurality of pixels arranged to the intersections of a plurality of vertical and horizontal scan lines forming a matrix display, and connected to a plurality of switches respectively;

a liquid crystal display control unit having a vertical driving circuit and a horizontal driving circuit, wherein the vertical driving circuit scans a display frame with a frame cycle and selects the plurality of the vertical scan lines sequentially, and wherein the horizontal driving circuit synchronizes with the scan of the frame cycle and writes the image signals to the pixels on the selected lines through the switches;

an illumination unit configured to illuminate the liquid crystal display panel according to a plurality of divided luminescent regions along the vertical scan lines; and an inverter circuit configured to illuminate the luminescent regions successively along the vertical scan lines while receiving and delaying the vertical synchronizing signal outputted from the liquid crystal display control unit synchronizing with the scan of the vertical scan lines, wherein the inverter circuit comprises:

a first turn-on timing circuit corresponding to a first luminescent region; and a plurality of second turn-on timing circuits and a plurality of turn-off timing circuits arranged to be connected in series and respectively corresponding to the second and the subsequent luminescent regions.

2. The device as claimed in claim 1, wherein the luminescent regions are divided into n regions where n is an integer greater than 2.

3. The device as claimed in claim 1, wherein the first turn-on timing circuit, the second turn-on timing circuits, and the turn-off timing circuits constitute a phase synchronous signal generator configured to generate a timing signal to determine the delay time of each luminescent region according to the vertical synchronizing signal of the inverter circuit.

4. The device as claimed in claim 3, wherein wherein the timing signal synchronizing with the vertical synchronizing signal is inputted to the first turn-on timing circuit of the first luminescent region to provide turn-on timing signals corresponding to each luminescent region; one of the first and the second turn-on timing circuits corresponding to the $k_{th}$ (k=1, 2, . . . , n−1) luminescent region is connected to one of the turn-off timing circuit circuits corresponding to the $(k+1)_{th}$ luminescent region; and one of the turn-off timing circuit circuits corresponding to the $(k+1)_{th}$ luminescent region receives the input signal from one of the first and the second turn-on timing circuit circuits corresponding to the $k_{th}$ luminescent region to delay the timing signal of the turn-on circuit for illuminating the $(k+1)_{th}$ luminescent region.

5. The device as claimed in claim 1, wherein the inverter circuit further comprises:

a temperature detector for detecting the temperature of the liquid crystal display panel to generate a temperature signal;

a temperature timing circuit configured to receive the vertical synchronizing signal and generating a timing signal according to the temperature signal to determine the illumination time of each luminescent region, wherein the temperature timing circuit, the first turn-on timing circuit, the second turn-on timing circuits, and the turn-off timing circuits constitute a phase synchronous signal generator; and a lamp drive controller for controlling the illumination unit with the timing signal.

6. The device as claimed in claim 5, wherein the inverter circuit is modified with a real temperature of the liquid crystal display panel according to the amplification rate from the temperature detector and the charge rate from the time constant of the phase synchronous signal generator.

7. The device as claimed in claim 5, wherein the temperature detector comprises a temperature sensor and an operational amplifier for amplifying the electric signal corresponding to the change of the resistance from the temperature sensor, and generating the temperature signal.

8. The device as claimed in claim 7, wherein the temperature timing circuit synchronizes with the vertical synchronizing signal based on the temperature signal and the vertical synchronizing signal from the temperature detector, and generates a temperature timing signal with the pulse width corresponding to the temperature signal.

9. The device as claimed in claim 5, wherein the luminescent regions are divided into n regions, where n is an integer greater than 2, and wherein the temperature timing signal synchronizing with the vertical synchronizing signal is inputted to the first turn-on timing circuit of the first luminescent region to provide turn-on timing signals corresponding to each luminescent region; one of the first and the second turn-on timing circuits corresponding to the $k_{th}$ (k=1, 2, . . . , n−1) luminescent region is connected to one of the turn-off timing circuits corresponding to the $(k+1)_{th}$ luminescent region; and one of the turn-off timing circuits corresponding to the $(k+1)_{th}$ luminescent region receives the input signal from one of the first and the second turn-on timing circuits corresponding to the $k_{th}$ luminescent region to delay the timing signal of the turn-on circuit for illuminating the $(k+1)_{th}$ luminescent region.

10. A liquid crystal display device, comprising:

a liquid crystal display panel having a plurality of pixels arranged to the intersections of a plurality of vertical and horizontal scan lines forming a matrix display, and connected to a plurality of switches respectively;

a liquid crystal display control unit having a vertical driving circuit and a horizontal driving circuit, wherein the vertical driving circuit scans a display frame with a frame cycle and selects the plurality of the vertical scan lines sequentially, and wherein the horizontal driving circuit synchronizes with the scan of the frame cycle and writes the image signals to the pixels on the selected lines through the switches;

an illumination unit configured to illuminate the liquid crystal display panel according to a plurality of divided luminescent regions along the vertical scan lines; and an inverter circuit configured to illuminate the luminescent regions successively along the vertical scan lines while receiving and delaying the vertical synchronizing signal outputted from the liquid crystal display control unit synchronizing with the scan of the vertical scan lines, wherein the inverter circuit comprises:

a temperature detector for detecting the temperature of the liquid crystal display panel to generate a temperature signal;

a phase synchronous signal generator configured to receive the vertical synchronizing signal and generating a timing signal according to the temperature signal to determine the delay time of each luminescent region; and a lamp drive controller for controlling the illumination unit with the timing signal.

* * * * *